US006637480B1

(12) United States Patent
Tobin et al.

(10) Patent No.: US 6,637,480 B1
(45) Date of Patent: Oct. 28, 2003

(54) VARIABLE VOLUME HEIGHT ADJUSTABLE BUFFER FOR TRANSFERRING ITEMS FROM AN ELEVATED SUPPLY STREAM TO A LOWER CONTAINER AND METHOD

(75) Inventors: Jon Tobin, Pittsford, NY (US); Kristin Leahy, Rochester, NY (US); Stanley May, Fairport, NY (US); Timothy Lemley, East Bethany, NY (US)

(73) Assignee: Han-Tek, Inc., Victor, NY (US)

( * ) Notice: Subject to any disclaimer, the term of this patent is extended or adjusted under 35 U.S.C. 154(b) by 0 days.

(21) Appl. No.: 10/145,343

(22) Filed: May 14, 2002

(51) Int. Cl.[7] ..... B65B 1/04

(52) U.S. Cl. ..... 141/387; 141/114; 141/10; 141/314; 220/495.01; 222/181.1; 222/212

(58) Field of Search ..... 141/10, 114, 313–317, 141/388, 387; 222/181.1, 181.2, 181.3, 207, 212, 434, 438, 440, 56; 220/495.01

(56) References Cited

U.S. PATENT DOCUMENTS

| | | | | |
|---|---|---|---|---|
| 30,465 | A | | 10/1860 | Curtiss |
| 1,208,445 | A | | 12/1916 | Arnold |
| 1,233,117 | A | | 7/1917 | Parker |
| 2,299,572 | A | | 10/1942 | Estenes |
| 2,468,497 | A | | 4/1949 | Johnson et al. |
| 3,105,592 | A | | 10/1963 | Cohen |
| 3,392,878 | A | | 7/1968 | Jackson |
| 3,661,211 | A | | 5/1972 | Powers |
| 4,294,059 | A | | 10/1981 | Stilwell et al. |
| 5,379,862 | A | | 1/1995 | Schmidt et al. |
| 6,085,807 | A | * | 7/2000 | Wright ..... 141/114 |

* cited by examiner

*Primary Examiner*—Steven O. Douglas
(74) *Attorney, Agent, or Firm*—Brian B. Shaw; Roger Aceto; Harter, Secrest & Emery, LLP

(57) ABSTRACT

A variable volume buffer is employed to conduct a multitude of articles from an elevated supply stream into a container at a lower elevation while maintaining a drop distance for the articles that is shorter than the distance from the source to the bottom of the container. The bottom of the buffer is vertically displaced in response to the height of the articles in the buffer in a continuous or step-wise function to maintain the fill level of the articles in the buffer at substantially a constant drop distance from the source. Upon the bottom of the buffer moving adjacent the bottom of the container, the gate is opened and the buffer is raised to permit the spilling of the articles directly from the buffer and into the container.

24 Claims, 3 Drawing Sheets

FIG. 2
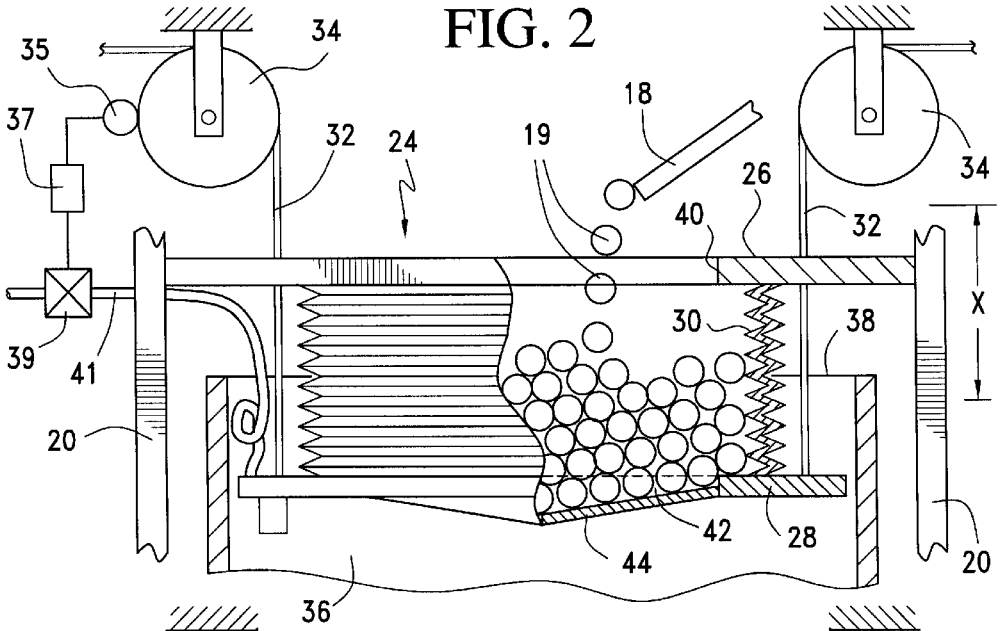
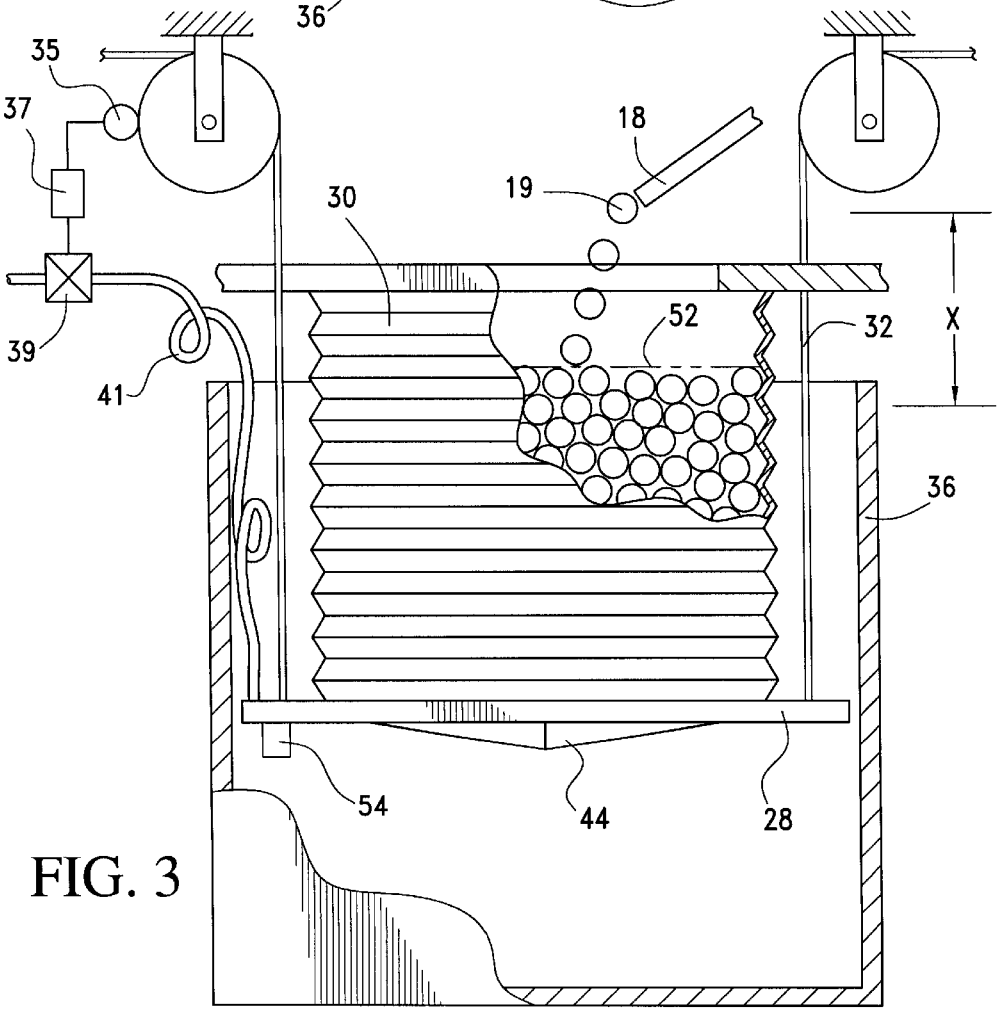
FIG. 3

VARIABLE VOLUME HEIGHT ADJUSTABLE BUFFER FOR TRANSFERRING ITEMS FROM AN ELEVATED SUPPLY STREAM TO A LOWER CONTAINER AND METHOD

FIELD OF THE INVENTION

The present invention relates to transferring items from an elevated supply stream to a container at a lower elevation. More particularly, the invention relates to a variable volume, height adjustable buffer for capturing and retaining a multitude of similar articles and then selectively batch dispensing the items into a container located at a lower elevation.

BACKGROUND OF THE INVENTION

Although the present invention may be used in conjunction with a variety of items often found in a supply stream such as, for example, food products, building components and manufacturing components, the present application finds particular use with preforms. Preforms are typically formed of a thermoplastic and are the initial material for thin wall containers such as bottles for soft drinks, detergents, etc. produced with blow molding machines.

In one method of blow molding plastic containers, such as polyethylene terephthalate (PET) carbonated beverage bottles, a preform first is formed by injection molding followed by reheating and stretch blow molding of such preforms into containers. The preforms are generally cylindrical tubes having a hemispherical closed end and an opposite open end with a ring shaped shoulder and threaded sleeve. Superficially, preforms generally resemble test tubes having a threaded end.

Depending upon the size of the container to be blow formed, the preforms have different sizes particularly in length and wall thickness, whereas the diameters are somewhat standardized with reference diameters being 22, 28 and 38 millimeters, measured on the outside of the thread.

The preforms are injection molded in large numbers at an injection molding machine, which includes a preform cooling or handling plate. After the preforms are removed from the injection molding machine, they are brought to an elevated position by a conveyor belt and then delivered by a chute to a large corrugated board box normally identified as a "gaylord" for storage and shipment. The preforms merely drop from the chute and into the gaylord. Since a gaylord may be four or more feet tall and the chute discharge is at a still higher elevation, the drop from the chute to the bottom of the gaylord may be five feet or more.

Surface damage of the preform typically occurs during dropping through such distances into the gaylord. Such damage is manifest by scratching or scuffing of the surface of the preform and in an extreme case in the chipping of a threaded surface. Since this damage occurs during loading of the articles which is after inspection, the damage often goes undetected. Consequently, such defects on the exterior surface of a preform result in a blow-molded container having an unacceptable surface contusion.

A number of methods have been applied to reduce the surface damage to preforms prior to the final blow molding process.

Specifically, U.S. Pat. No. 5,509,965 discloses immediately coating preforms after the injection molding of such preforms to prevent damage of the preforms by engagement with one another.

However, such processes typically require additional materials as well as processing equipment, thereby adding to the cost.

Accordingly, a need exists for a system that can transfer, with a minimum of damage, preforms from the injection mold supply stream at a higher elevation and into a container at a lower elevation for storage and subsequent transport.

The need further exists for a such a system for loading a multitude of similar articles into relatively deep containers that minimizes damage to the articles particularly where the articles are dropped from a relatively high elevation relative to the bottom of the container.

There is a yet further need for such a system for loading a multitude of similar articles into a deep container wherein the drop or fall distance into the container is kept relatively constant regardless of the container height.

SUMMARY OF THE INVENTION

In accordance with the present invention, a vertically oriented buffer is positioned between the discharge of a chute and the bottom of the gaylord. The buffer establishes and maintains a relatively constant drop height so the preforms only drop a short distance into the buffer. In this respect the buffer has expandable sides that allow the base of the buffer to move from a higher elevation to a lower elevation. As preforms accumulate and pile onto the base of the buffer, the buffer sides expand downwardly. In this fashion the base is lowered so the top of the pile of preforms remains at a substantially constant elevation relative to the discharge end of the chute.

The buffer is sized and positioned to fit within the gaylord so that as the base is lowered, it extends into the gaylord. When the base of the buffer is at or near the bottom of the gaylord an opening in the base is created so the preforms can be dispensed into the gaylord. The buffer is collapsed by raising the base and this results in a controlled dispensing of the preforms into the gaylord through the open base.

Accordingly, the present invention may be characterized in one aspect thereof by an apparatus for maintaining a relatively constant drop distance during the filling a container having an open top and a closed bottom with a multitude of similar articles from a source located at a higher elevation, the apparatus including:

a) a vertically expandable buffer disposed intermediate the elevated source and the container for receiving the articles directly into the buffer from the elevated source;

b) a top frame at a fixed location defining a buffer inlet;

c) a bottom frame defining a buffer outlet including a gate closing the outlet, the bottom frame being sized to fit into the container and being movable between an elevated position adjacent the top frame to a lower position, the bottom frame at the onset of filling being at the elevated position disposed a defined vertical distance below the elevated source that defines an initial drop distance of articles falling from the source and into the buffer;

d) expandable sides connecting the top and bottom frames;

e) control means for controlling the descent of the bottom frame in response to the entry of articles into the buffer that fill the buffer to a fill level for maintaining a distance between the fill level and the source that is substantially equal to the initial drop distance; and f) means opening the gate responsive to the positioning of the bottom frame at the lower position.

In another aspect the present invention may be characterized by a method for filling a container with a multitude of similar articles comprising:

a) dispensing the articles from an elevated source and through a defined drop distance into an expandable buffer disposed below the source and above the container;

b) expanding the buffer downwardly and into the container as the buffer is filled with the articles so as to maintain substantially the defined drop distance; and c) opening a gate in the buffer when the buffer is expanded to a selected lower level for dispensing the articles into the container by dropping them from the buffer and the distance dropped from the buffer into the container being no greater than the defined drop distance.

BRIEF DESCRIPTION OF THE DRAWINGS

FIGS. 2–5 are side elevation views partly broken away and in section showing the apparatus at various stages of a filling operation.

DETAILED DESCRIPTION OF THE PREFERRED EMBODIMENT

Figure 1:
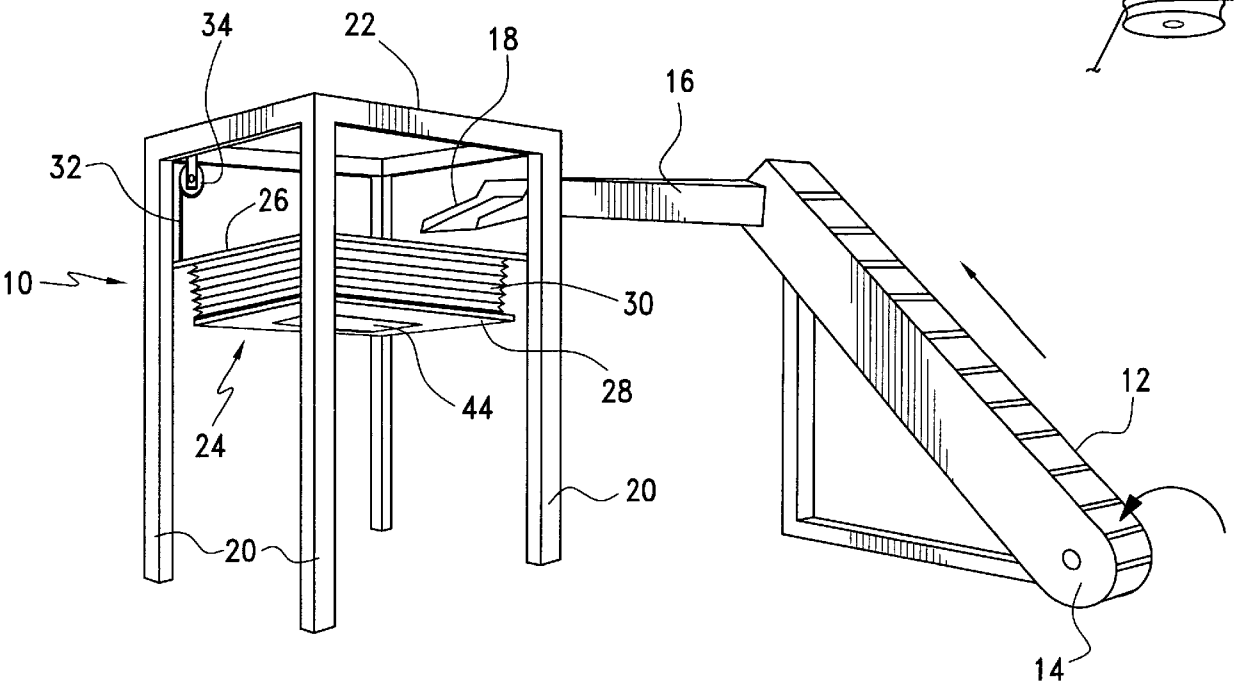
FIG. 1 is a perspective view showing the apparatus of the present invention.

Referring to FIG. 1, the apparatus of the present invention, generally indicated at 10 is shown in association with other loading apparatus such as a conveyor 12. As noted hereinabove, the apparatus of the invention is used in a loading system wherein articles are dispensed from an elevated source into gaylord containers. In the present situation the articles are preforms produced by a conventional injection molding machine (not shown). The out put of the injection molding machine, comprising a multitude of similar articles, is delivered to the conveyor lower end 14. The conveyor carries the articles to a higher elevation and dumps them onto a horizontal conveyor 16, which in turn delivers the articles to a chute 18. The articles then drop from the chute and into a gaylord container (not shown in FIG. 1) disposed below the chute.

FIG. 1 shows the apparatus 10 to include a generally upright support structure formed by upright legs 20 and a top bracket 22 that connects the legs. The spacing and height of the legs 20 is such that the support structure can accommodate a gaylord container positioned between the legs and below the top bracket.

Suspended from the support is an expandable buffer 24. The buffer includes a top frame 26 and a bottom frame 28. The top frame 26 is fixed at its ends to the upright legs 20 at an elevation that is just below the level of the discharge of the chute 18. The bottom frame 28 is vertically adjustable relative to the top frame and is shown in FIG. 1 at or close to its highest position. Extending between the top and bottom frames is an expandable wall 30 forming the sides of the buffer. As the bottom frame is lowered with respect to the top frame, the sides 30 expands downwardly so the volume of the buffer increases responsive to the downward movement of the bottom frame. The expandable wall can take any appropriate form such as telescoping tubes or rectangular sections. A preferred arrangement as disclosed in the Figures is a pleated structure.

Any suitable means is attachable to the bottom frame to accomplish a controlled decent of the bottom frame relative to the top frame. In FIG. 1 the control is shown as including a cable 32 attached to each corner of the bottom frame (only one cable being shown for clarity of the Figure). Each cable passes over a pulley 34 attached to the top bracket 22 and then passes onto a motor driven reel or windlass (not shown).

FIG. 2 shows the buffer 24 of FIG. 1 on an enlarged scale. The Figure also shows a portion of a container 36 in position between the upstanding legs 20 of the support frame. As can be seen, the top frame 26 of the buffer is in a fixed position above the top edge 38 of the container and the bottom frame 28, shown near its highest position, can fit into the container. It also should be appreciated that in the position shown, the bottom frame 28 is a measured distance "X" below the discharge end of the chute 18.

The top frame 26 has an opening 40 for receiving articles into the buffer. The bottom frame 28 has a dispensing opening 42 for dispensing articles from the buffer. A trap door or gate 44 closes the dispensing opening. Preferably the gate comprises rigid double doors made of stainless steel or a rigid plastic. Each of the double doors is hinged at one end to the bottom frame 28. In the closed position, the doors meet and butt together as shown in FIG. 2.

Associated with one of the pulleys 34 is a geared limit switch 35. The limit switch counts the revolutions of the pulley in order to determine the distance that the bottom frame 28 travels from the top frame 26. When the geared limit switch travels a selected number of revolutions, it triggers a solenoid 37. The solenoid in turn is connected to an air valve 39. When the valve is opened, pressurized air is admitted through a hose 41 connected to a pneumatic cylinder (not shown) that operates the double doors of the gate 44.

Figure 6:
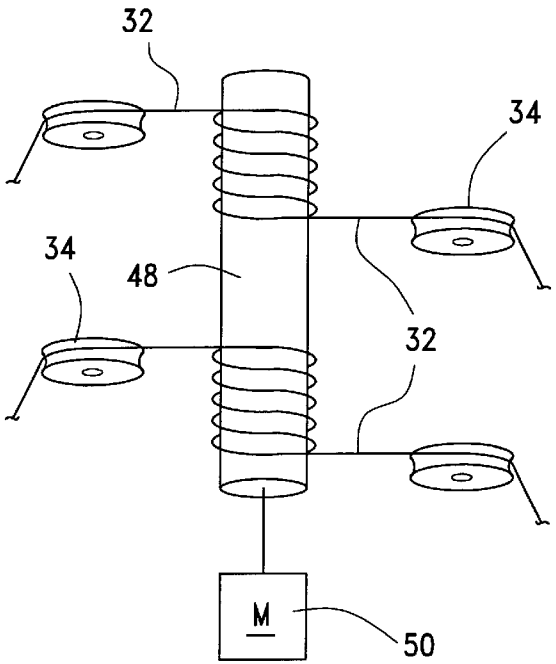
FIG. 6 is a schematic view showing a reel arrangement for use in the present invention.

To complete the structure, FIG. 6 shows one arrangement for controlling the elevation of the bottom frame. In this respect the arrangement shown is attached to the upright supporting structure of FIG. 1 and includes four pulleys 34, one associated with each corner of the bottom frame 28. The cable 32 passing over each pulley is wound onto a reel 48 that is driven by a motor 50. Operation of the motor acts to reel in or play out the cables 32 in a controlled fashion for raising and lowering the bottom frame 28 of the buffer.

Operation is described as beginning with the condition as shown in FIG. 2. In this condition the bottom frame is at or near its highest elevation and the drop distance "X" is established between the bottom frame 28 and the discharge chute 18. In this condition articles dropping from the chute have only a relatively short drop as represented by the distance "X" to the bottom frame of the buffer. As articles begin to fill the volume between the top and bottom frames, the motor 50 (FIG. 6) is operated to play out the cables 32 and controllably lower the bottom frame 28.

As the bottom frame descends, the sides 30 of the buffer downwardly expand and the bottom frame passes into the container 36 as shown in FIG. 3. The descent of the bottom frame is accomplished in a controlled manner so as to maintain the fill level 52 of the articles in the buffer at a substantially constant distance from the discharge of the chute 18. Preferably this distance corresponds to the distance "X" between the initial elevation of the bottom frame 28 and the chute discharge end as shown in FIG. 2. The result of the controlled descent of the bottom frame in this manner is that the distance that the articles fall or drop from the chute and onto the pile of the articles within the buffer remains small and substantially constant. This avoids a long drop as measured from the discharge chute to the bottom of the container 36 and reduces the potential of damage to the articles being loaded into the container.

As the buffer is filled and expands downwardly, the gear limit switch in effect counts the revolutions of the pulley 34.

At a selected number of revolutions corresponding to the point where the bottom frame 28 is at a desired lower level close to the bottom of the container, the descent of the bottom frame is halted. The geared limit switch then activates the solenoid 37 and valve 39 to pressurize the cylinders that operate the double doors of the gate 44.

Figure 4:
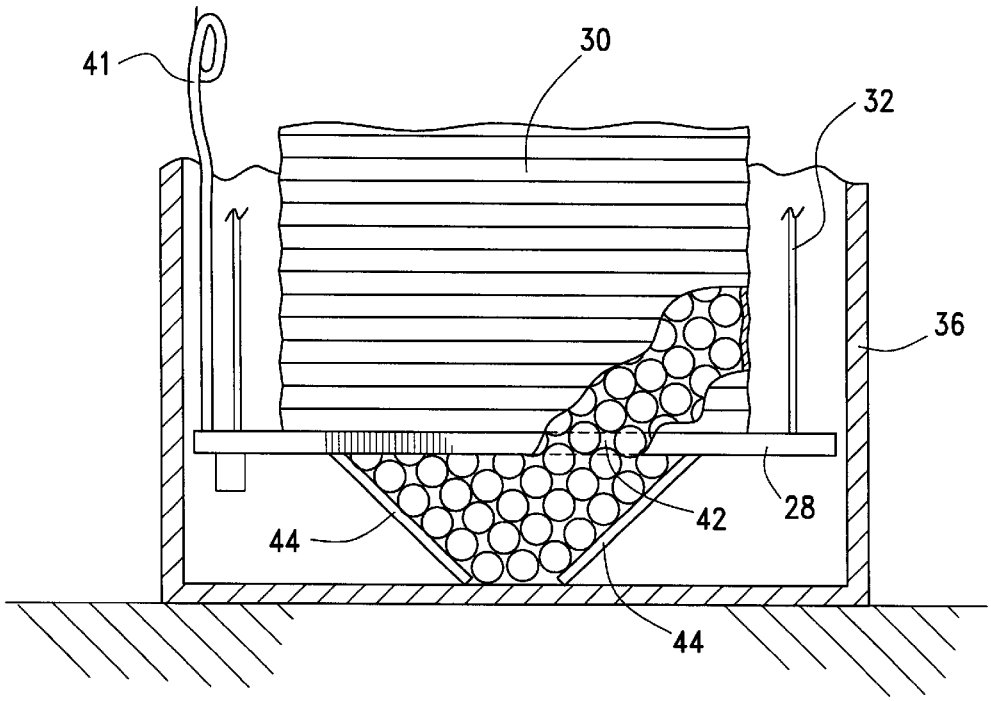
Figure 5:
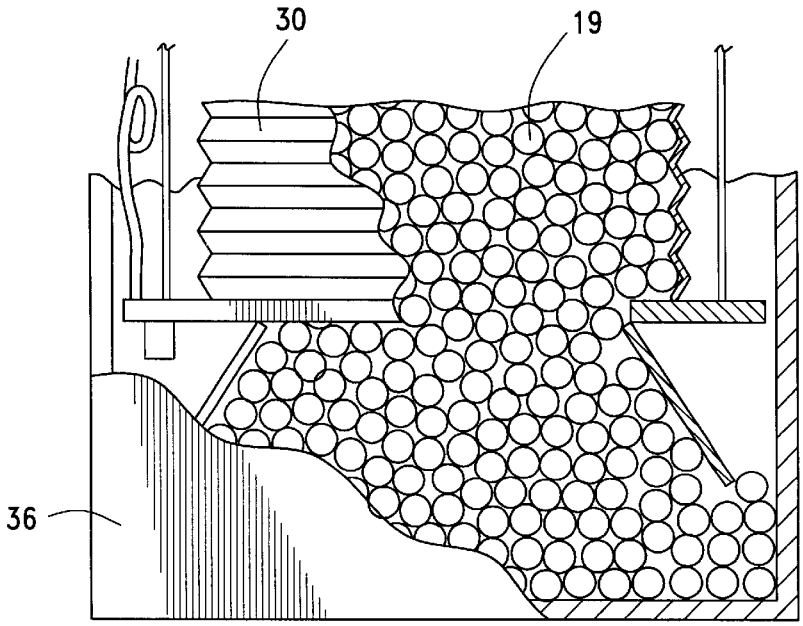

As shown in FIG. 4, operating the double doors to open the gate 44 allows the articles in the buffer to release through the opening 42 and into the container 36. After the gate is opened, the motor 50 (FIG. 6) is reversed to raise the bottom frame 28. This allows the articles to spill from the buffer in a controlled manner through the opening 42 and into the container as shown in FIG. 5. In the usual case, the capacity of the buffer is less than the capacity of the container 36. Accordingly, after the descent of the bottom frame is stopped, the conveyor 16 may continue to deliver articles to the buffer until a desired article count is reached that corresponds to a filled container. At that point, the delivery of articles into the buffer will stop.

The gate 44 can be opened when the bottom frame 28 is high enough above the bottom of the container to permit the double doors of the gate to swing completely open. However, in this case the drop distance to the bottom of the container 36 may be greater than the drop distance "X". Accordingly, to provide a shorter drop to the bottom of the container 36, the bottom frame 28 may be lowered to a point where the double doors may not swing completely free after opening as shown in FIG. 5. In this case the double doors will not swing completely open until the buffer is raised some distance as shown in FIG. 5.

When the buffer is elevated to its start position (FIG. 2) pressure on the pneumatic cylinders is reversed and the double doors of the gate 44 are closed so filling of the buffer can begin again.

As noted above, the supply stream delivered from the chute 18 typically is the output of a preform molding machine wherein in the newly injected preforms comprise a multitude of similar articles to be transferred to a container for storage and shipment. Although it is preferred that the supply stream be constant so as to deliver a predetermined number of units in a given time, the supply stream may be variable.

Generally, the present invention includes a variable volume buffer, a volume adjusting mechanism and a release mechanism.

The variable volume buffer as described above has an inlet for receiving the supply stream, an outlet with a gate for selectively passing the accumulated supply stream from the buffer into the container.

While shown as a square or rectangular structure, the buffer can have a cross section that is another rectilinear arrangement or it can be circular or oval. The buffer as described is extensible between a collapsed position and a extended position. In a preferred construction, the expandable buffer is formed by a pleated or accordion, non-elastic material. Such materials include canvas or plastic composites or laminates that may have living hinges to form the pleats.

In a first configuration, a top frame defines the inlet to the buffer. The top frame preferably is generally set at a fixed location relative to the supply stream such as by fixing it to an upright supporting structure.

The outlet of the buffer comprises a bottom frame that can be disposed in a variety of elevations between a lower position and a raised position. The outlet includes a gate moveable between an open position and a closed position. Although the gate may have a variety of dimensions, it is preferably sized to represent a substantial portion, at least greater than 50% of the cross sectional area of the buffer. A gate of such a large cross sectional area provides a large opening to better transfer the accumulated articles in the buffer to the container. In this respect a large opening allows the articles to spill from the buffer so as to uniformly cover the bottom of the container and fill the container evenly as the bottom frame is raised.

A preferred release mechanism for selectively permitting movement of the gate from the closed position to the open position is described including a pneumatic cylinder activated by a predetermined expansion of the buffer as determined by the gear limit switch 35. It should be appreciated that other release mechanisms can be used such as a hydraulic cylinder and opening of the gate can be triggered by other means. For example, a contact or proximity switch 54 located on the bottom frame as shown in FIG. 3 or at the bottom of the container 36 or a manually pulled lanyard can trigger the opening of the gate. The release of articles from the buffer also may be controlled by any of a variety of mechanisms including height dependent, weight, optical or timing and can be located either on the buffer or on the floor of the container.

While rigid members described as double doors are preferred for closing the gate 44, a cloth or cloth-like structure that depends from about the periphery of the opening 42 and is gathered and closed by a releasable clasp also may be used.

As described hereinabove, a height adjustment mechanism is connected to the buffer and preferably the bottom frame of the buffer for selectively varying the displacement of the bottom of the buffer relative to the supply stream. Preferably the height adjustment mechanism is responsive to, or corresponds to, or is controlled by, the supply stream rate, weight of material in the buffer, or by optical or mechanical sensing means.

While a system of cables is described as the means for controllably lowering the bottom frame 28, it should be appreciated that the height adjustment mechanism can include pneumatic or hydraulic cylinders, jackscrews, scissors jacks or other appropriate means for controlling the descend and subsequent elevation of the bottom frame.

As the operation of the invention is described, the buffer initially is disposed with the bottom frame and the buffer outlet in an elevated position and the gate is closed. This arrangement allows the articles in the supply stream to drop a relatively short distance "X" into the buffer through the inlet. This is because the buffer is in the collapsed position and the bottom of the buffer is adjacent the inlet so a minimum drop height is defined between the bottom of the buffer and the source of the supply stream. The drop distance "X" as described herein is defined as the distance between the average level of articles in the buffer and the discharge of the chute 18.

As the quantity of preforms retained in the buffer increases, the level 52 of the pile of articles in the buffer rises and the drop distance decreases. Accordingly, the height adjustment mechanism is actuated either in steps or in a continuous movement to lower the bottom frame of the buffer thereby increasing the buffer volume to maintain a substantially constant drop distance "X". If the lowering of the bottom frame is done in a step process, it is preferable to maintain the drop distance within a predetermined maximum value.

As the drop distance "X" is at a preferably minimum height, the energy imparted to each article dropping into the buffer is reduced so the available energy for inducing surface defects on the articles as they drop is likewise reduced. Moreover, the eventual drop distance of the articles as they are introduced into the container from the buffer is likewise reduced to a minimum. This is because the outlet (bottom) of the buffer is continually lowered to accommodate additional preforms from the supply stream and the release mechanism is operated only after the bottom of the buffer is at the preselected lower level near the container bottom.

Upon operation of the release, the gate is opened and preforms are permitted to pass through the opening 42 in the bottom of the buffer and into the container. The height adjustment mechanism then is actuated to gradually retract the buffer by elevating the bottom frame 28. As the bottom frame is raised, the retained articles spill and pour through the opening 42 and enter the container without a distinct or discrete vertical drop.

After the buffer is emptied, the gate is closed and the buffer is disposed in the retracted position to repeat the process.

Thus it should be appreciated that the present invention accomplishes its objects in providing a system for loading a multitude of similar articles into a relatively deep containers that minimizes damage to the articles dropping into the container. The invention further provides for loading a multitudes of articles into a container wherein the drop or fall distance of the articles into the container is kept relatively constant regardless of the container height.

Having described the invention in detail, what is claimed as new is:

1. Apparatus for maintaining a relatively constant drop distance during the filling of an upright container with a multitude of similar articles from an elevated source, the container having an open top and a closed bottom and the apparatus comprising:

a) a vertically expandable buffer disposed intermediate the elevated source and the container for receiving the articles directly into the buffer from the elevated source;

b) a top frame at a fixed location defining a buffer inlet;

c) a bottom frame defining a buffer outlet including a gate closing the outlet, the bottom frame being sized to fit into the container and being movable between an elevated position adjacent the top frame to a lower position, the bottom frame at the onset of filling being at the elevated position disposed a defined vertical distance below the elevated source that defines an initial drop distance of articles falling from the source and into the buffer;

d) expandable sides connecting the top and bottom frames;

e) control means for controlling the descent of the bottom frame in response to the entry of articles into the buffer that fill the buffer to a fill level for maintaining a distance between the fill level and the source that is substantially equal to the initial drop distance; and f) means opening the gate responsive to the positioning of the bottom frame at the lower position.

2. Apparatus as in claim 1 wherein the buffer is carried by a supporting structure comprising upright legs spaced to accommodate the container therebetween and having a top bracket connecting the upright legs above the container.

3. Apparatus as in claim 2 wherein the top frame of the buffer is fixed to the supporting structure.

4. Apparatus as in claim 1 wherein the expandable sides comprise a pleated structure.

5. Apparatus as in claim 1 wherein the control means for controlling the descent of the bottom frame is responsive to one of the rate of entry of articles into the buffer or the weight of articles in the buffer.

6. Apparatus as in claim 1 wherein the control means for controlling the descent of the bottom frame comprises a retractable cable having one end attached to the bottom frame.

7. Apparatus as in claim 6 comprising a plurality of the retractable cables attached at spaced points along the bottom frame, each of the cables being carried over a pulley attached to the supporting structure and wound onto a reel for selectively reeling in or playing out the cable.

8. Apparatus as in claim 1 including a limit sensor for determining the positioning of the bottom frame at the lower level and said means for opening the gate acting responsive to the limit sensor.

9. Apparatus as in claim 8 wherein the limit sensor is a counter for determining the distance traveled by said bottom frame.

10. Apparatus for selectively filling a container with a multitude of similar articles from an elevated supply stream comprising:

a) a variable volume buffer disposed vertically intermediate the container and the elevated supply stream for filling with articles from the supply stream, the buffer including a top located inlet, a gated bottom located outlet and an expandable wall between the inlet and outlet;

b) height adjustment means operatively connected to the buffer for moving the buffer between a retracted position wherein the outlet is at a higher elevation and adjacent the inlet at the onset of filling the buffer and an expanded position wherein the outlet is at a lower elevation disposed within the container at the completion of filling the buffer; and c) a release operable to open the gated bottom at the expanded position for the dispensing of articles from the buffer and into the container.

11. Apparatus as in claim 10 wherein the height adjustment means provides for the controlled descent of the outlet responsive to the filling of the buffer to maintain the drop distance of articles from the elevated source into the buffer substantially constant during the filling of the buffer and the descent of the outlet.

12. Apparatus as in claim 11 wherein the buffer includes a bottom frame containing the gated outlet and the height adjustment means comprises a retractable cable attached to the bottom frame.

13. Apparatus as in claim 10 wherein the expandable wall comprises a pleated structure.

14. Apparatus as in claim 10 wherein the buffer is carried by a supporting structure extending above the container, the top located inlet being fixed relative to the supporting structure and the gated bottom located outlet being movable relative to the supporting structure.

15. Apparatus as in claim 14 wherein the supporting structure accommodates a container and the height adjusting means comprises at least one pulley fixed to the supporting structure, a cable passing over the pulley having one end connected to the buffer adjacent the bottom located outlet and a reel for playing out or reeling in the cable to respectively lower or raise the bottom outlet.

16. Apparatus as in claim 10 including indicator means issuing a signal indicating the arrival of the gated bottom located outlet at the lower elevation and said release being operable in response to the signal.

17. Apparatus as in claim 16 wherein the indicator means is a geared limit switch operably connected to said at least one pulley.

18. A method a method for filling a container with a multitude of similar articles comprising:

a) dispensing the articles from an elevated source and through a defined drop distance into an expandable buffer disposed below the source and above the container;

b) expanding the buffer downwardly and into the container as the buffer is filled with the articles so as to maintain substantially the defined drop distance; and c) opening a gate in the buffer when the buffer is expanded to a selected lower level and raising the buffer to remove the buffer from the container for dispensing the articles into the container by dropping them from the buffer and the distance dropped from the: buffer into the container being no greater than the defined drop distance.

19. A method as in claim 18 comprising collapsing the buffer after opening the gate to facilitate the dispensing of the articles into the container.

20. A method as in claim 18 comprising:

a) fixing the location of a top of the buffer relative to the elevated supply source while a bottom of the buffer is movable with respect to the elevated supply source;

b) locating the bottom of the buffer at an initial position relative to the supply source such that the space between the supply source and the bottom of the buffer establishes the drop distance therebetween; and c) lowering the buffer bottom relative to the supply source responsive to the entry of the articles into the buffer thereby expanding the volume of the buffer and maintaining the drop distance between the supply source and the average fill level of the articles in the buffer substantially constant.

21. A method as in claim 20 wherein lowering the bottom of the buffer is responsive to the weight of articles in the buffer.

22. A method as in claim 20 wherein lowering the bottom of the buffer is responsive to the volume of articles dropped into the buffer.

23. A method as in claim 20 wherein lowering the bottom of the buffer is responsive to a timed period representing a defined number of articles.

24. Apparatus for selectively filling a container with a multitude of similar articles from an elevated supply stream comprising:

a) a variable volume buffer disposed vertically intermediate the container and the elevated supply stream for filling with articles from the supply stream, the buffer including a top located inlet, a gated bottom located outlet and an expandable wall between the inlet and outlet;

b) height adjustment means operatively connected to the buffer for moving the buffer between a retracted position wherein the outlet is at a higher elevation and adjacent the inlet at the onset of filling the buffer and an expanded position wherein the outlet is at a lower elevation disposed within the container at the completion of filling the buffer and the height adjustment means providing a controlled descent of the outlet responsive to the filling of the buffer to maintain the drop distance of articles from the elevated source into the buffer substantially constant during the filling of the buffer and the descent of the outlet; and c) a release operable to open the gated bottom at the expanded position for the dispensing of articles from the buffer and into the container.

* * * * *